US005167079A

United States Patent [19]

Bowen

[11] Patent Number: 5,167,079

[45] Date of Patent: Dec. 1, 1992

[54] APPARATUS AND METHOD FOR CLEANING PIEZOELECTRIC CRYSTAL COMPONENTS

[75] Inventor: Curtis E. Bowen, Camp Hill, Pa.

[73] Assignee: Precision Quartz Products, Inc., Camp Hill, Pa.

[21] Appl. No.: 727,555

[22] Filed: Jul. 9, 1991

[51] Int. Cl.[5] ..... F26B 19/00

[52] U.S. Cl. ..... 34/60; 34/18; 34/39

[58] Field of Search ..... 34/4, 18, 39, 40, 41, 34/60

[56] References Cited

U.S. PATENT DOCUMENTS

| | | | |
|---|---|---|---|
| 3,914,836 | 10/1975 | Hafner et al. | 29/25.35 |
| 3,932,777 | 1/1976 | King | 310/8 |
| 4,021,898 | 5/1977 | Willis et al. | 29/25.35 |
| 4,259,606 | 3/1981 | Vig | 310/343 |
| 4,311,938 | 1/1982 | Ballato et al. | 310/311 |
| 4,392,287 | 7/1983 | Peters | 29/25.35 |
| 4,638,536 | 1/1987 | Vig | 29/25.35 |
| 4,811,493 | 3/1989 | Burgio | 34/4 |
| 4,961,271 | 10/1990 | Butler | 34/60 |

*Primary Examiner*—Stephen M. Hepperle
*Attorney, Agent, or Firm*—Thomas Hooker

[57] ABSTRACT

An apparatus and method for treating components used in the manufacture of piezoelectric crystals having a very stable oscillating frequency includes an oven with infrared heating lamps and a tray with a removable glass cover. The tray is fitted in the oven so radiant energy from the lamp heats the components in the tray. Nitrogen is continuously flowed through the interior of the tray during the heating to remove oxygen and water vapor together with contaminants driven from the components during heating.

13 Claims, 4 Drawing Sheets

APPARATUS AND METHOD FOR CLEANING PIEZOELECTRIC CRYSTAL COMPONENTS

FIELD OF THE INVENTION

The invention relates to an apparatus and method for manufacturing very stable piezoelectric crystals.

DESCRIPTION OF THE PRIOR ART

Piezoelectric crystals are used to control the frequency of oscillation in circuits and normally include a carefully manufactured crystal base which is connected to contacts such that when an oscillating voltage is applied across the base, the crystal vibrates at a frequency dependent upon the properties of the crystal, including the total mass that oscillates with the crystal. It has been long recognized that in order to make a very stable piezoelectric crystal, for stabilizing an oscillator over a long period of time, it is necessary to remove surface contaminants from the crystal and from the parts that are enclosed with the crystal. This is because surface contaminants contribute to the mass of the crystal which in turn determines the frequency of the crystal. In long term usage, contaminants may migrate away from or to the crystal, thereby changing the mass of the crystal and resulting in drift of the frequency of the crystal. Change in the frequency of the crystal means that the oscillator controlled by the crystal drifts and does not operate as intended.

Piezoelectric crystals commonly use quartz base plates which are manufactured and tuned to a very precise frequency. However, conventional manufacturing processes do not remove all surface contaminants from the crystals and associated components enclosed with the crystals with the result that the crystal frequency drifts. This is a particular problem when the crystals and other components are used in inaccessible locations, such as earth satellites, where it is not possible to replace the crystals with new, properly tuned crystals.

Change in crystal frequency due to contamination results in drift in the oscillator frequency which impairs the operation of the end/use system. This drift, for instance, may result in the inability of a tuned radio frequency transmitter or receiver to operate in a desired frequency band. Further, oscillator driven timing circuits lose accuracy because of oscillator drift.

SUMMARY OF THE INVENTION

The invention is an apparatus and method for very thoroughly cleaning the components used in the manufacture of a piezoelectric oscillator crystal. The cleaning assures that surface contaminants are removed from the base plates and all of the components enclosed with the base plates and sealed in the interior of the completed crystal.

The crystal components to be cleaned are placed in a special tray having a glass cover which is closed to confine the components within the tray. The tray is then fitted within an oven and nitrogen is continuously flowed into the tray, past all of the components and then out through openings located in the sides of the tray. The continuous nitrogen flow entrains the atmospheric gas initially trapped within the tray when the tray is closed following loading and expels the atmospheric gas, including oxygen and water vapor, from the tray.

The components in the tray are heated by infrared lamps located in the oven above the tray. The infrared radiation passes freely through the glass cover on the top of the tray to raise the temperature of the components to a high bake temperature where surface contaminants are evaporated or driven off from the components. The oxygen and water vapor originally captured in the tray when the top is closed are entrained and removed from the interior of the tray with the continuously flowing nitrogen gas before the components are heated to an oxidizing temperature to prevent oxidation of metal components when they are heated to a high bake temperature.

Following cleaning of the components in the tray and cooling of the components and tray, the tray is removed from the oven with the cover in place and taken to a clean work area where the components are processed or assembled with other baked clean crystal components during the manufacturing operation. The glass plate is maintained closed on the tray to prevent contaminants in the atmosphere from falling on and dirtying the clean components and nitrogen is preferably flowed continuously through and out the tray to prevent reverse inward atmospheric flow.

Partially manufactured crystal components are placed in a tray and baked in order to remove contaminants following performance of the various steps required to manufacture crystals. Thus, during the entire manufacturing process, individual components may be heated and baked to remove contaminants many times. The repetitive heating and baking in the oven assures that the finished crystal is free of contaminants and, as a result, very highly stable. Following heat baking of the finished crystal assembly and the cap that normally surrounds the assembly, the cap and assembly are welded together in order to confine the heated, cleaned crystal assembly within the interior of the cap, free of contaminants.

The various manufacturing operations required in the assembly of a crystal are performed in clean areas free of contamination. Some operations are performed in a dry box filled with nitrogen where operators carry out manufacturing operations using barrier gloves. Other operations are carried out in a clean atmospheric gas.

The trays in which the components are heat baked are cooled and then moved into the clean work areas to assure that when the trays are open the components are in a clean environment free of contamination. Likewise, at the end of each manufacturing step the components are placed back in the trays, and the trays are closed in the clean area in order to assure that the components are not contaminated during transport from the clean work area back to the oven. The removable cover on the top of the tray seals the components in the tray against particle contamination during transport to and from the oven. Nitrogen gas may be flowed through the tray during transport back to the oven.

Heating efficiency of the oven is improved by preheating the nitrogen flowed through the tray using a spiral coil located above the infrared heating lamps. Heat from the lamps heats the coil to heat the nitrogen and improve the efficiency of the oven. The increase in thermal efficiency of the oven resulting from preheating the nitrogen is on the order of 25 percent.

Other objects and features of the invention will become apparent as the description proceeds, especially when taken in conjunction with the accompanying drawings illustrating the invention, of which there are 5 sheets and one embodiment.

DESCRIPTION OF THE PREFERRED EMBODIMENT

Figure 1:
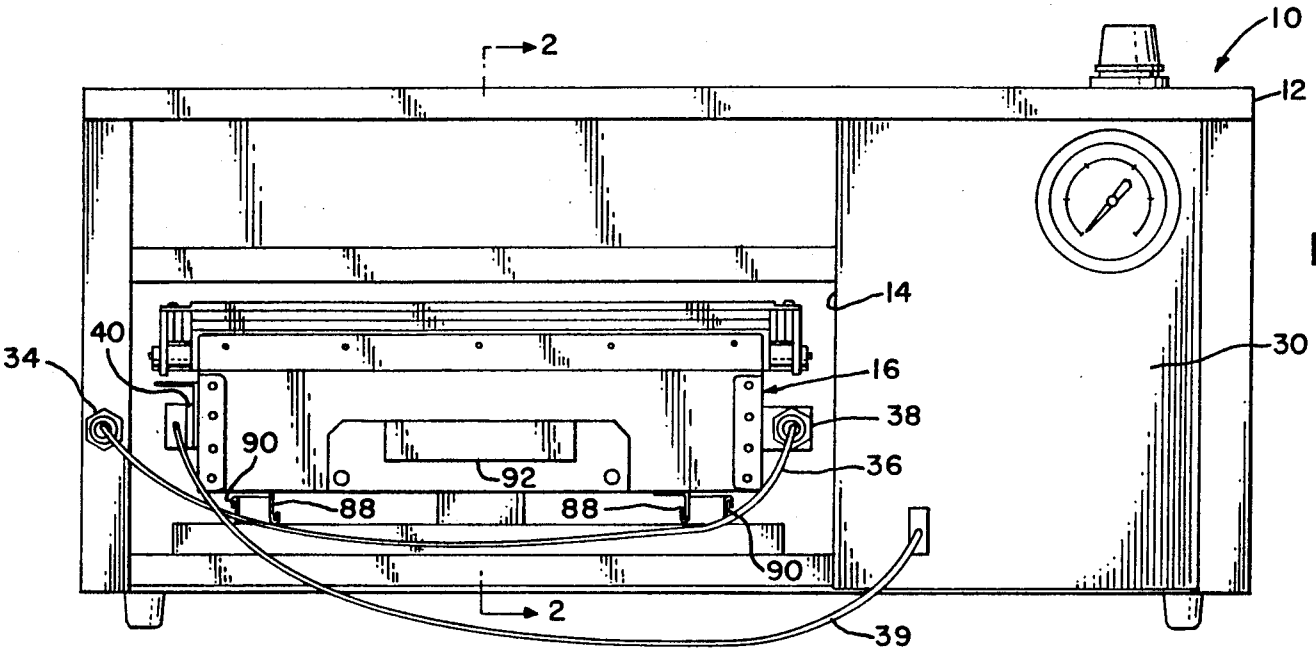
FIG. 1 is a front view showing an oven and tray for removing impurities from components of piezoelectric devices.

Piezoelectric crystal treating apparatus 10 includes an oven 12 having a tray-receiving recess 14 in the front of the oven as shown in FIG. 1. Tray 16 is removably positioned within recess 14 in order to heat crystal components placed in the tray in a controlled environment to remove surface impurities and gases and stabilize the frequency of crystals made from the components. The components are heated by infrared light from a heating assembly in the oven. The controlled environment prevents oxidation on the components due to the presence of oxygen or water vapor within the tray.

The oven 12 includes heating assembly 18 located above recess 14. This assembly includes four infrared quartz lamps 20 spaced above and extending across the recess and a stainless steel mesh plate 22 located above the lamps. Circumferential wall 24 extends around the plate and lamps. The wall is provided with an inwardly directed circumferential lip 26 located below the lamps. When the lamps are turned on, the wall prevents light from the lamps from escaping from the oven while assuring that the light falls directly on piezoelectric crystal components positioned in the tray.

The lamps 20 and plate 22 are suspended below a stainless steel reflecting plate 28 located adjacent the top of the oven 12. When the lamps are on, an appreciable amount of the upward directed light from the lamps 20 is reflected back down to the tray by the mesh plate 22. Some the light passes through openings in plate 22, strikes plate 28 and is reflected back downwardly by the plate. The openings in plate 22 permit cooling air to circulate up past the lamps 20.

Oven 12 also includes a nitrogen gas manifold and control system for flowing heated nitrogen gas into the tray 16 when mounted in the recess 14. The nitrogen manifold includes a port for connecting the manifold to a source of pressurized nitrogen gas and a pressure control valve for controlling the pressure of the nitrogen flowed to the tray. These components are not illustrated in the drawings. The controller is adjustable from panel 30 located to one side of the recess 14. The nitrogen manifold includes a tube extending from the controller to a tube spiral 32 mounted in the oven immediately above plate 28 and extends to a port 34 located in the side of the opening away from the panel. A removable nitrogen line 36 connects port 34 to port 38 on the tray.

The oven also includes an oven temperature control circuit (not illustrated) for monitoring the temperature of the interior of tray 16. The temperature control circuit is removably connected to a thermocouple located in the interior of the tray 16 by lead 39 which engages thermocouple contact 40 located on one side of the tray.

Tray 16 includes a rectangular body 42 having four side walls 44 and a bottom wall 46. Edge strips 48 extend along the outer upper edges of each side wall 44 and are provided with upwardly facing edges 50 extending above the sidewalls 44. The edges 50 in adjacent strips join at the corners of the tray so that the edges 50 lie in a plane generally parallel to the bottom wall 46 and located a distance above the sidewalls 44. The edges are circumferentially continuous to form a seal engaging glass plate 58 to close the hollow interior of the tray. A rectangular inner liner 52 is fitted within body 42 and includes sidewalls and a bottom wall spaced inwardly a slight distance from sidewalls 44 and bottom wall 46. A perforated nitrogen diffuser plate 54 is positioned on spacers 55 in the bottom of the inner liner above the bottom wall.

Tray cover assembly 56 includes a rectangular glass plate 58, a rectangular frame 60 which surrounds and moves the plate and a pair of side rails 62 located on opposite sides of the body 42. The frame 60 includes a pair of opposed side rails 64 and a pair of end rails 66. Blocks 68 are mounted on the inner ends of rails 64 and are provided with inwardly facing recesses 70. Opposed ends of the plate 58 are fitted freely within the recesses 70 to permit limited free movement of the plate relative to the frame 60. See FIG. 5. When the frame is positioned over body 42 plate 58 covers the top of the body and rests flush on the circumferential edges 50 of strips 48.

Figure 4:
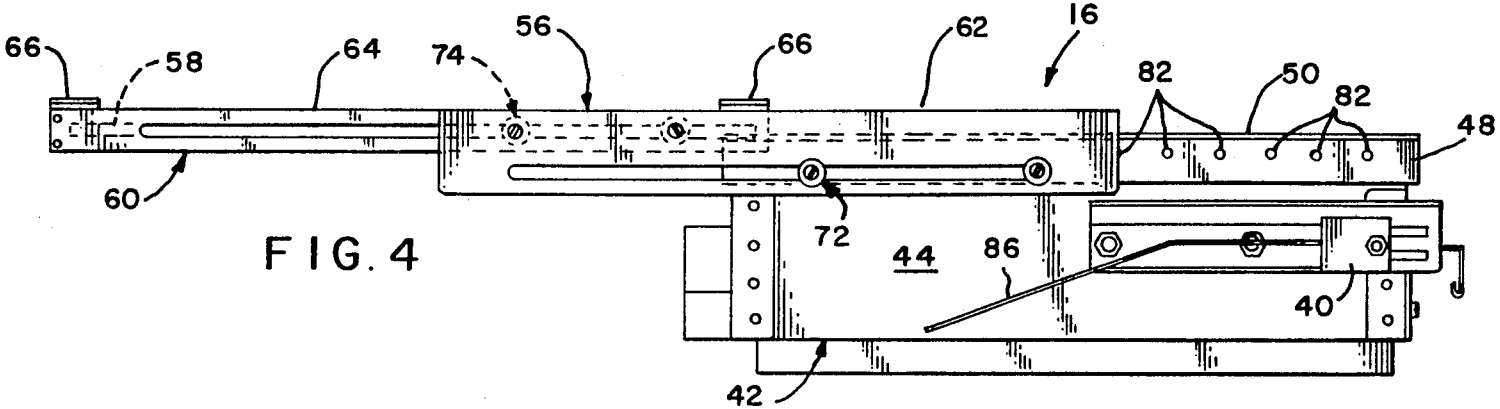
FIG. 4 is a side view of the tray in the open position.
Figure 5:
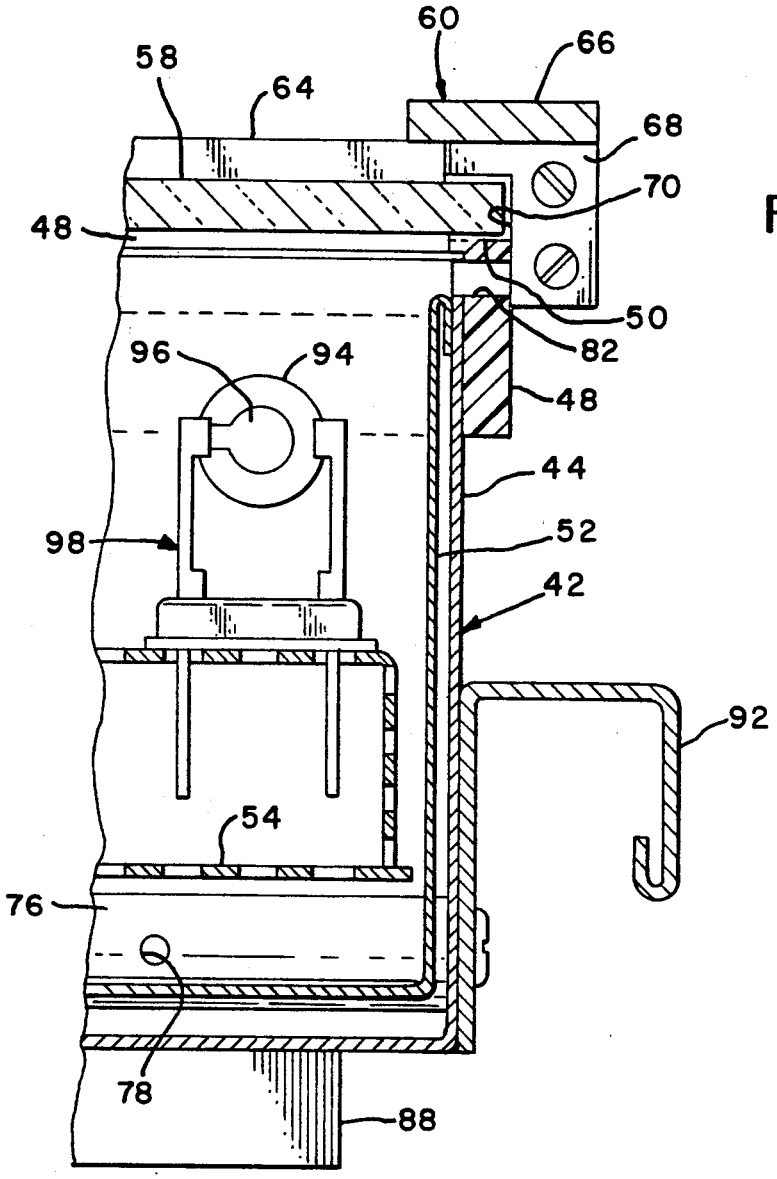
FIG. 5 is a sectional view taken along line 5—5 of FIG. 3.

The cover 58 and frame 60 are connected to body 42 by rails 62 and slide and pin connections 72 and 74 joining rail 62 to the body and joining the rail 62 to rail 64. These connections permit movement of the plate 58 and frame 60 to one side of the inner liner to open the tray and permit loading and unloading of components to be treated in the tray. See FIG. 4. When the tray is open, one edge of the plate rests on the rear edge strip 48. The closed position in which the frame and plate overlie the tray the plate rests on the top of the four circumferential strips 48 as shown in FIG. 5.

Figure 3:
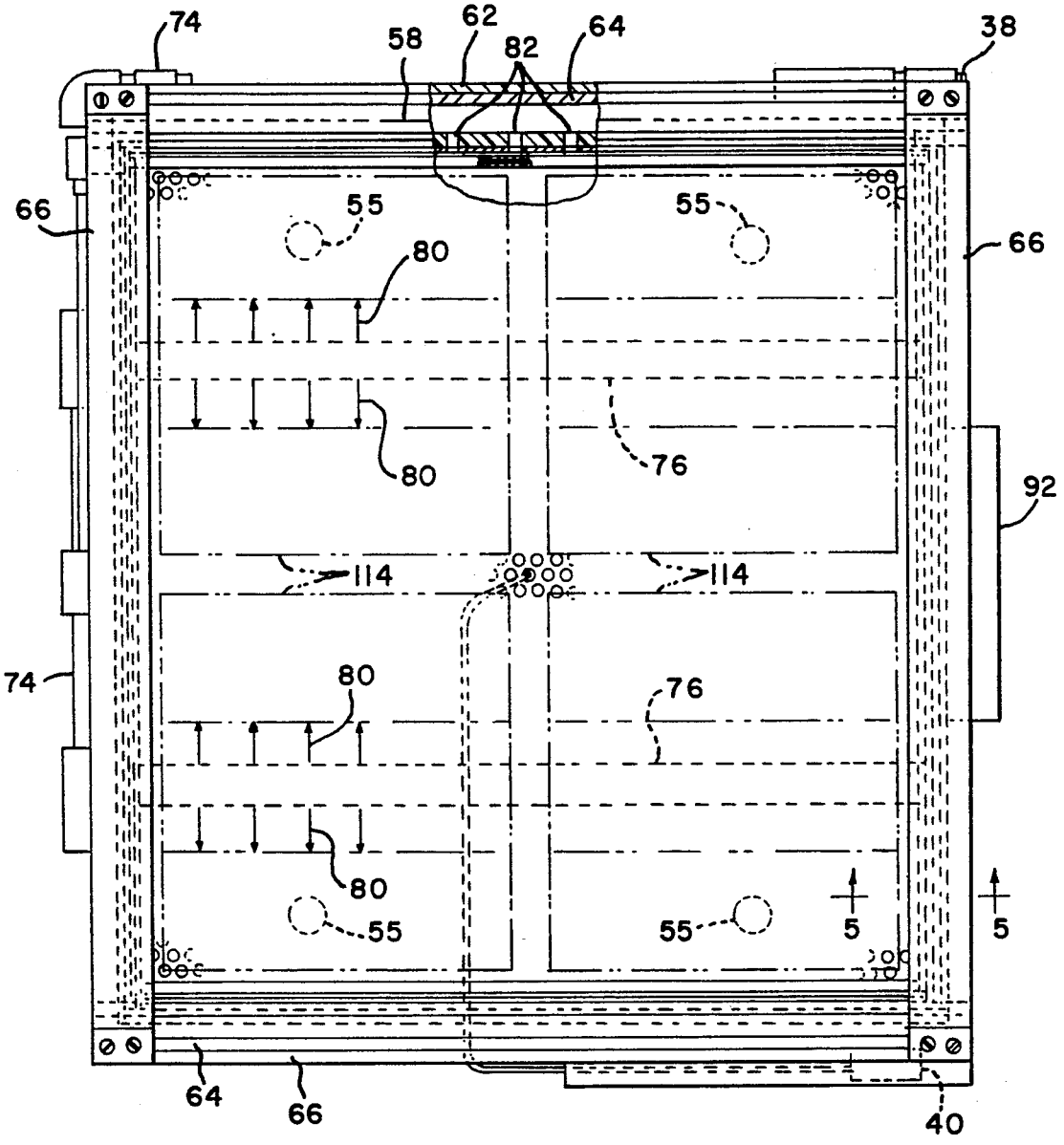
FIG. 3 is a top view of the tray taken along line 3—3 of FIG. 2.

The tray includes a nitrogen flow line 74 extending from port 38 in the front of the tray behind the body 42 to two spaced, parallel nitrogen discharge tubes 76 in the tray extending along the bottom wall 46 of body 42. The tray wall 44 is joined to the tubes 76 to prevent leakage into or out of the tray at the tubes. A series of spaced discharge openings 78 are provided in the opposite sides of the tubes 76 above the bottom of the inner liner 52 so that nitrogen flowed through line 74 and tubes 76 is flowed out from both sides of the tubes in the directions of arrows 80 across the bottom of the inner liner 52 as shown in FIG. 3. The bottom of the inner liner is located below the holes 78 and above the bottom 46 of body 42.

Figure 2:
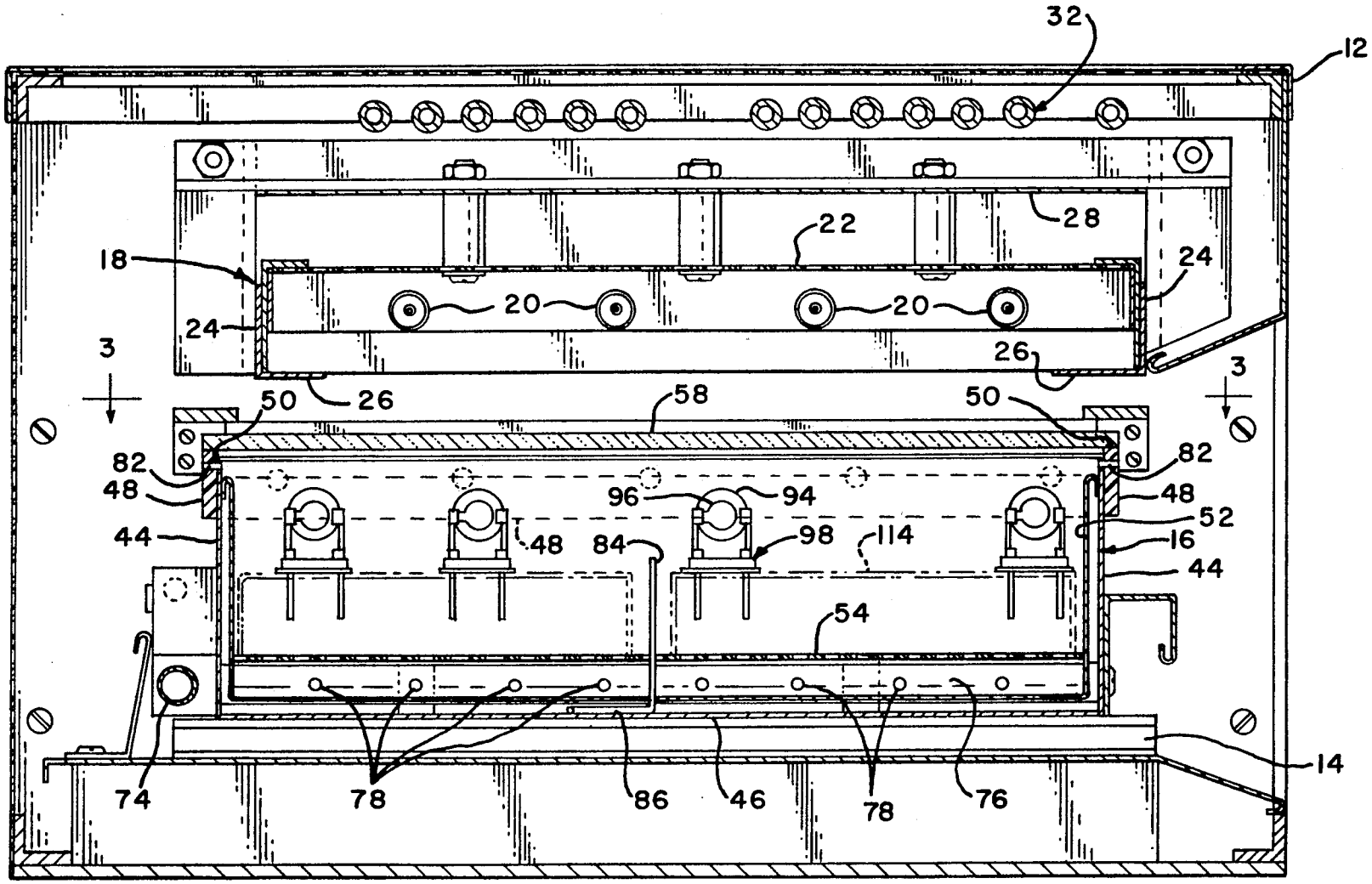
FIG. 2 is a sectional view taken along line 2—2 of FIG. 1.

The outward flow of nitrogen from the tubes 76 fills the bottom of the inner liner 52 beneath perforated plate 54 and flows upwardly through the perforations in the plate to fill the interior of the tray uniformly, and surround components in the tray. With the plate 58 closed as in FIG. 2 the upward flow of nitrogen flows across the bottom of the glass plate 58, and out of the tray through a series of small diameter holes 82 extending through edge strips 48 and the top of walls 44 on the opposite sides of the tray. See FIG. 5. Holes 82 are provided along the length of both opposed sides of the tray. The weight of the glass plate 58 forms a seal with edges 50 to prevent uneven outward flow of the nitrogen between the plate and side strips 48.

The exit holes 82 prevent build-up of pressure within the interior of the tray sufficient to lift the glass plate 50 above strips 48 to vent nitrogen directly from the interior of the tray. This type of venting is undesirable because it is not possible to determine which edge of the plate will lift from a side strip 48 or where maximum venting will occur. Such venting produces an uncontrolled and irregular flow of nitrogen within the interior of the tray so that nitrogen does not flow uniformly around and protect all of the components in the tray as they are heated and while the initial atmospheric gas trapped within the tray is vented from the tray. The outward flow of nitrogen through the two rows of holes 82 assures that the nitrogen flows past all of the components and protects all of the components in the tray against oxidation prior to removal of all the water vapor and oxygen, in the atmospheric gas initially trapped in the tray.

Thermocouple sensor 84 extends upwardly from the bottom of body 42 into the interior of the tray. An electrical lead 86 connects the sensor to thermocouple contact 40.

The tray 16 has a pair of bottom rails 88 which cooperate with rails 90 in the bottom of the oven recess 14 to assure proper location of the tray within the recess. Handle 92 on the front of the tray facilitates positioning the tray in the recess and removing the tray from the recess.

Figure 6:
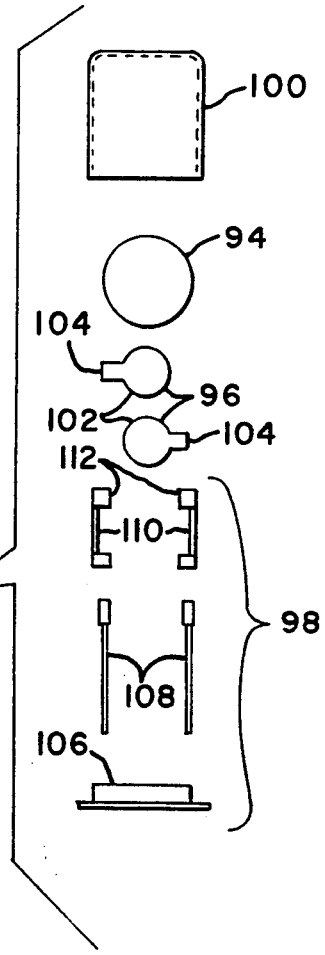
FIG. 6 is an exploded view of the components of a typical piezoelectric crystal.

The apparatus 10 is used to heat treat the components of a piezoelectric crystal to remove surface impurities and vent undesired gases released during cement curing. FIG. 6 is an exploded view showing the components of a typical piezoelectric crystal including a cylindrical base plate 94 formed of crystalline piezoelectric material, commonly quartz, metal electrodes 96, a preassembled contact assembly 98 and a hollow metal cover 100. The electrodes 96 each include a disc portion 102 deposited in the center of one side of the base plate 94 and an electrode 104 extending to the edge of the base plate. The two electrodes 104 extend to opposite edges of the base plate.

The contact assembly 98 is shown in an exploded view in FIG. 6. This assembly includes a metal eyelet or base 106 with a pair of metal contact leads 108 extending through the center of the base and secured to the base by a glass-to-metal seal to accomplish a hermetic seal with the base. Contact clips 110 are welded to the upper ends of leads 108 and include C-shaped contacts 112 on the upper ends thereof adapted to be fitted around the opposed edges of the base plate 94 to make electrical contact with adjacent electrodes 104. A conductive cement is used to bond the contacts 112 to the crystal base plate.

Cover 110 is fitted over the assembled, cleaned and tuned crystal and then welded to the eyelet or base 106 to seal the interior of the crystal against contamination.

The method of operation of the apparatus 10 will now be described with reference to the manufacture of a very accurate quartz crystal for use in a highly stable oscillator, it being understood that the method be used to manufacture resonators using piezoelectric elements other than quartz.

The apparatus 10 is used by placing a large number of components to be cleaned in suitable holders in the interior of the tray 16, closing the cover 58 on the tray and then placing the closed tray into the recess 14 in the oven 12 so that the components are located beneath the heating lamps. Nitrogen flow line 36 is connected to ports 34 and 38 thereby establishing a nitrogen flow path extending from the source of nitrogen past the pressure regulator, through heating spiral 32 and line 36 to the nitrogen discharge tubes 76 in the tray. The regulator is adjusted to flow nitrogen into the interior of the tray at a pressure of about 3 to 20 pounds per square inch. The nitrogen flows out through holes 78 across the bottom of the interior of the tray and is diffused as it flows upwardly through the perforated support plate 54 to form a uniformly distributed upward flow moving past and surrounding the supported components. The flow continues upwardly and then moves along the bottom of glass plate 58 and past the top of the walls of the inner liner 52 and out of the tray through the discharge holes 82. Each component is surrounded by nitrogen. The atmospheric air and water vapor trapped in the tray are entrained with the nitrogen and are flowed out of the tray through openings 82.

Thermocouple lead 39 is connected to thermocouple contact 40 to enable the temperature controller in the oven to control the temperature in the interior of the tray using sensor 84 according to a predetermined temperature profile for removing surface contaminants from the particular component in the tray.

The temperature controller controls the output of lamps 20 to maintain the temperature within the interior of the tray in order to perform the desired removal of surface contaminants from the piezoelectric crystal components being heated and treated. For instance, quartz base plates 94 may be slowly elevated in temperature to a temperature of approximately 300 degrees Centigrade and maintained at 300 degrees Centigrade for a bake time of between one to three hours. The base plates are then slowly cooled. In this way, surface impurities on the base plates are effectively vaporized and removed without stressing the quartz and impairing the piezoelectric properties of the plates.

During heating, baking and cooling, nitrogen flows continuously into the interior of the tray and past the components to prevent oxidation of metal component surfaces. Oxidation may occur when the components are heated to a temperature of approximately 225 to 250 degrees Centigrade. This temperature is reached before the components are fully baked and while contaminants remain on the surface of the base plates. Oxidation may occur if oxygen remains in the tray in contact with the components when they are heated to this temperature range. The continuous uniform flow of nitrogen past the components purges oxygen and water vapor from the interior of the tray prior to oxidizing of metal component surfaces. The contaminants are vaporized from the components during the subsequent high temperature baking within the chemically inert nitrogen atmosphere.

The pressurized flow of nitrogen into the bottom of the tray, up the tray and then out the exit holes 82 maintains the interior pressure of the tray above atmosphere in order to prevent atmosphere gas, which includes oxygen and water vapor, from flowing back into the interior of the tray during heat treatment of components in the tray. Body 42 is imperforate, with the exception of holes 82. Glass cover-plate 58 is likewise imperforate and rests on the edges 50 to form a seal thereby effectively closing the interior of the tray and preventing undesired oxygen and water vapor entry during the heat treatment of components in the tray.

At room temperature a low flow rate of nitrogen can be provided through port 38 for staging or storing components during the manufacturing process to minimize exposure to normal atmosphere. Nitrogen may be flowed through the tray while moving the tray from the oven to a clean work area and back to the oven.

The loose fit between the ends of the plate 58 and end blocks 68 assures that the plate rests freely on the edges 50 to form a seal assuring the nitrogen flows from the plate 54 past all the parts to be treated in the tray and out openings 82. An inadvertent increase in pressure in the nitrogen flowed to the tray may lift plate 58 above the edges 50 to vent the high pressure nitrogen directly to atmosphere. During normal operation, the plate rests directly on the edges 50, as described.

During heating of the contents of tray 16, nitrogen flows through the controller, and through the tube spiral 32 located above reflecting plate 28 and then into tube 76 and throughout the tray. Light energy from lamps 20 passes through the stainless steel mesh plate 22 and hits the reflecting plate 28. A considerable amount of energy is reflected back toward the plate 22 and, ultimately, the tray. However, plate 28 is heated and radiates heat upwardly to heat the tube spiral 32 thereby heating the nitrogen passing through the spiral and into the tray. In this way, the temperature of the nitrogen as flowed into the tray is increased and the heating efficiency of apparatus 10 is increased by capture of energy which would otherwise be lost. The use of preheated nitrogen increases the heating efficiency of the apparatus. This efficiency saves energy and, if required, permits the temperature within tray 16 to be increased rapidly to the high temperature required for baking and cleaning components of piezoelectric crystals.

The use of apparatus 10 in the manufacture of a quartz resonator from components shown in FIG. 6 will now be described.

The first step in the operation is to remove surface contamination from a number of base plates 94. The base plates are mounted on suitable supports 114 which are placed in the tray on plate 54. After loading the base plates and supports into the tray the cover 58 is closed and the tray is placed in recess 14 of oven 12. Line 36 and lead 39 are attached as shown in FIG. 1. The temperature programmer in the oven is programmed to control the temperature within the tray in accordance with the requirements for proper heating and cleaning the base plates. Commonly, the program includes a gradual increase of the temperature within the tray to a high baking temperature of about 300 degrees Centigrade. This temperature is maintained for the required bake period following which the temperature is gradually decreased. The quartz crystal base plates are slowly heated and cooled to avoid stress injury.

The baking of the base plates is initiated by turning on lights 20 and at the same time flowing nitrogen gas into the interior of the tray through the discharge holes 78. Infrared radiation from the bulbs 20 passes through the glass plate 58 and falls on the base plates and the tray thereby heating the base plates. Nitrogen flowing up from the bottom of the tray is diffused by the plate 54 and flows past the base plates. This upward nitrogen flow entrains the atmospheric gas initially trapped in the tray when the plate 58 was closed and flows this gas, including oxygen and water vapor, out of the tray through the discharge holes 82. The water vapor and oxygen initially trapped within the tray are completely removed from the tray by the nitrogen flow by the time the temperature of the base plates is raised to about 225–250 degrees Centigrade to prevent oxidation. Heat energy from the lamps radiating upwardly above plate 28 raises the temperature of the tube spiral 32 to preheat the nitrogen flowing into the tray and thereby increase the heating efficiency of the tray.

After the base plates have been heated to a desired bake temperature of about 300 degrees Centigrade the temperature of the tray is maintained for a bake period of one to three hours, depending upon the requirements of the particular base plate. Thereafter, the temperature in the tray is slowly reduced to a sufficiently low temperature to permit removal of line 36 and lead 39 and movement of the tray from the oven and placement of the tray in a clean work area where the cover 58 is opened and the clean base plates are removed and placed in a suitable jig for vacuum deposition of gold electrodes 96 on the opposite sides of the plates.

During movement of the tray to the clean work area the cover 58 is maintained in place on the top of the tray to prevent particulate contaminants in the surrounding atmosphere from falling into the interior of the tray and contaminating the clean base plates. Nitrogen through an extended line 36 to port 38 is maintained at a low pressure during the movement of tray 16 to the clean work area and during the loading unloading operations.

After the electrodes 96 have been vacuum deposited on the surfaces of the base plates, the base plates are again placed in the tray in the clean work area, the cover is closed and the tray is inserted into the oven 12 for another programmed clean cycle to remove contaminants which may possibly have fallen on the base plates or contaminated the electrodes during deposition of the electrodes on the base plates. Nitrogen continually flows through the tray during these operations. At the end of this cycle, the tray is once more removed from the oven for subsequent mounting of the clean base plates and electrodes on a clean, preassembled contact assembly 98.

Preassembled contact assemblies 98 are placed on suitable jigs 114 in a tray which is then inserted in the oven recess. The contact assemblies are then heated to a programmed high bake temperature and baked for a sufficient period of time to remove surface contamination, as previously described in connection with the baking and removal of surface contamination from the base plate. Following this operation, the tray containing the clean contact assemblies is removed, with the cover plate 58 in place, and transported to a clean assembly site where previously cleaned base plates with electrodes are mounted in the contacts 112 at the upper ends of the assembly using a conductive cement.

Following the mounting operation, the contact assemblies and plates are mounted on jigs 114 and placed in a tray while in the clean area. See FIG. 2 which illustrates the assemblies and plates supported in jigs 114 within the closed tray. The plate 58 is then closed in the clean work area and the tray is once more placed in oven 12. The controller in the oven is programmed to control the temperature in the tray in order to properly bake and cure the conductive material forming a bond between the clips and contacts 112 and the electrodes 96 and also clean the entire assembly of impurities. During the cycle the bonding material can give off gases and other volatiles which are removed from the interior of the tray with the nitrogen flowing out discharge holes 82. The bake cycle properly cures the bonding material forming the physical and electrical connections between the contacts 112 and the disks and electrodes on the disk.

Following cleaning of the assemblies 98 and plates 94 and curing of the bonding material holding the plates in the assemblies, the tray is once more transported to a clean work area and the assemblies are removed from the trays and individually connected to an oscillator to check the vibratory frequency. The base plates 94 have been manufactured to have a frequency slightly higher than the desired frequency of the manufactured crystals. The actual frequency of each plate 94 is determined and additional metal is added to the electrodes 96 to adjust the frequency downwardly to the exact desired frequency. After this operation has been completed for all of the assemblies in the tray, the assemblies are once more returned to the tray, the tray is closed and it is moved from the clean work area back to the oven where the assembly is once more heated and baked to remove any possible surface contamination. In order to assure all surface contaminants are removed from the assembly and plate during this heat treating cycle, the tray may be maintained at a high bake temperature for 4 to 60 hours. This long bake effectively assures that surface contaminants are removed from the assembly, from the disk and from the contacts. Following this operation, the tray and assemblies are once more cooled, transferred to a nitrogen filled dry box where the capping operation is subsequently performed.

Next, a tray is loaded with a number of piezoelectric crystal caps 100 positioned in suitable jigs in the tray, the cover 58 is closed and the tray is inserted in the oven. The oven is actuated to raise the temperature of the caps and circulate an inert nitrogen atmosphere over the caps. The covers are maintained at a bake temperature sufficiently long to remove surface impurities from the covers. Following the bake cycle the apparatus 10 is deactivated and the temperature in the tray lowers sufficiently to permit withdrawal of the tray and placement of the tray in the clean work area together with a tray containing the clean assemblies 98 and tuned plates 94. The covers are then placed over the plates and rest on the eyelets 106. A circumferential weld is then formed between the cap 100 and the eyelet 106 to form a hermetic seal between the covers the eyelets, thereby confining the cleaned, tuned crystal assembly in the clean, contamination-free covers. The resultant quartz crystal has a very high frequency stability enabling the crystal to maintain the desired frequency for an exceedingly long period of time.

If desired, during the final bake step one-half of the tray may be filled with tuned assemblies and plates and the other one-half filled with caps 100. The assemblies and caps are then baked for a long cycle as previously described. Following cooling, the tray is once more moved to a nitrogen-filled dry box where the capping operation is performed joining the caps to the cleaned crystal assemblies.

The operation of apparatus 10 has been described in connection with the treatment of the components of a high stability quartz oscillator crystal. Clearly, the apparatus may be used to clean components of other types of piezoelectric crystal devices if required.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as may invention is:

1. Apparatus for cleaning surface impurities from components of piezoelectric resonators used to drive oscillators, the apparatus including, a) an oven having tray-receiving means, heating means adjacent the tray-receiving means for heating components of piezoelectric crystals positioned in the tray, and an inert gas flow system for flowing inert gas continuously from a source of inert gas to inert gas inlet means on the tray; and b) a tray having a body defining an interior treatment compartment, a transparent cover removably closing the top of the compartment, support means in the compartment for supporting components to be cleaned, inert gas inlet means for flowing inert gas into the compartment and past components of piezoelectric crystals held by the support means during heating, baking and cooling of the components, gas discharge means communicating the interior of the compartment with the exterior of the compartment for flowing inert gas and entrained atmospheric gas, including oxygen and water vapor initially trapped in the compartment, out from the compartment to purge oxygen and water vapor from the compartment.

2. Apparatus as in claim 1 including inert gas diffusing means located in the compartment between the inert gas inlet means and the support means for distributing the flow of inert gas throughout the compartment.

3. Apparatus as in claim 2 wherein said inert gas inlet means is located at the bottom of the compartment, and the inert gas diffusing means extends across the compartment above the inert gas inlet means.

4. Apparatus as in claim 3 wherein the inert gas diffusing means comprises a perforated plate.

5. Apparatus as in claim 4 wherein the inert gas inlet means comprises a tube extending along the bottom of the compartment and including gas outlet means spaced along the tube for flowing inert gas into the interior of the compartment below the plate.

6. Apparatus as in claim 3 wherein the gas discharge means is located at the top of the compartment adjacent the cover.

7. Apparatus as in claim 6 wherein the gas discharge means extends along the side of the body.

8. Apparatus as in claim 7 wherein the gas discharge means comprises a plurality of discharge openings extending through the side of the body.

9. Apparatus as in claim 1 wherein the inert gas flow system includes a pre-heat portion located adjacent the heating means for preheating inert gas prior to flowing such gas into the compartment.

10. An apparatus as in claim 9 including a reflecting plate located between the heating means and the preheat portion of the inert gas flow system.

11. Apparatus as in claim 2 including an inner liner located within and spaced from said body, said support means and inert gas inlet means being located within the inner liner.

12. Apparatus as in claim 2 wherein said body includes an upwardly facing planar surface surround the top of the compartment and a frame loosely supporting said cover so that when the tray is closed the cover rests freely on said surface to close the compartment.

13. Apparatus as in claim 4 wherein the cover is glass and the heating means is a source of infrared electromagnetic radiation.

* * * * *